US007876281B2

(12) United States Patent
Akiho

(10) Patent No.: US 7,876,281 B2
(45) Date of Patent: Jan. 25, 2011

(54) MAGNETIC MATERIAL, MAGNETIC SHEET, AND PORTABLE ELECTRONIC APPARATUS

(75) Inventor: Hiraku Akiho, Miyagi (JP)

(73) Assignee: Sony Corporation, Tokyo (JP)

( * ) Notice: Subject to any disclaimer, the term of this patent is extended or adjusted under 35 U.S.C. 154(b) by 199 days.

(21) Appl. No.: 12/195,107

(22) Filed: Aug. 20, 2008

(65) Prior Publication Data

US 2009/0085820 A1 Apr. 2, 2009

(30) Foreign Application Priority Data

Sep. 28, 2007 (JP) ..... 2007-253438

(51) Int. Cl.
*H01Q 7/08* (2006.01)

(52) U.S. Cl. ..... 343/788; 343/702

(58) Field of Classification Search ..... 343/702, 343/788, 787, 895

See application file for complete search history.

(56) References Cited

U.S. PATENT DOCUMENTS

2005/0264460 A1* 12/2005 Sunaga ..... 343/702
2007/0069961 A1* 3/2007 Akiho et al. ..... 343/702

FOREIGN PATENT DOCUMENTS

| | | |
|---|---|---|
| JP | 55-65349 | 5/1980 |
| JP | 11131196 | * 5/1999 |
| JP | 11293338 | * 10/1999 |
| JP | 11302741 | * 11/1999 |
| JP | 2001-28418 | 10/2001 |

* cited by examiner

*Primary Examiner*—HoangAnh T Le
(74) *Attorney, Agent, or Firm*—K&L Gates LLP

(57) ABSTRACT

A magnetic material used for an antenna module of an RFID (radio frequency identification) system that uses a communication frequency of 13.56 MHz, includes an Fe alloy magnetic material containing Fe as a primary component, and Si and Al added thereto, and phosphorous of 0.2 to 0.5 wt % added to the Fe alloy magnetic material.

12 Claims, 5 Drawing Sheets

MAGNETIC MATERIAL, MAGNETIC SHEET, AND PORTABLE ELECTRONIC APPARATUS

CROSS REFERENCES TO RELATED APPLICATIONS

The present application claims priority to Japanese Patent Application JP 2007-253438 filed in the Japanese Patent Office on Sep. 28, 2007, the entire contents of which being incorporated herein by reference.

BACKGROUND

The present application relates to a magnetic material constituted of an Fe alloy used for improving performance of an antenna in, for example, an RFID (radio frequency identification) system, a magnetic sheet constituted of the magnetic material, and a portable electronic apparatus to which the antenna is mounted.

In RFID systems, non-contact-type IC tags in each of which an IC chip on which information is recorded and a resonance capacitor are electrically connected to an antenna coil are known. Regarding the non-contact-type IC tags, there are also card-type IC tags and built-in-type IC tags incorporated into cellular phones and the like.

As an antenna module of the related art used for the non-contact-type IC tags, there is known an antenna module in which a magnetic member (magnetic sheet) is disposed to be substantially in parallel to a plane of a spiral-type flat antenna coil wound on the plane thereof. The antenna module of this type uses a magnetic sheet formed of a material high in magnetic permeability. Due to such a magnetic sheet, an inductance of the flat antenna coil is increased and a communication distance is improved.

An example of a magnetic material used for the magnetic sheet is a magnetic material constituted of an Fe alloy that contains Fe as a primary component, such as an Fe—Si—Al (sendust) alloy and an Fe—Si—Cr alloy. Hereinafter, the magnetic material constituted of an Fe alloy that contains Fe as a primary component may simply be referred to as "Fe alloy magnetic material". When an additive amount of Si becomes large (e.g., 4.5 wt % (weight percent) or more), the Fe alloy magnetic material is increased in hardness and becomes poor in ductility.

Meanwhile, there are cases where the magnetic sheet as described above is produced by using flattened magnetic particles as a raw material (see, for example, Japanese Patent Application Laid-open No. 2001-284118 (paragraph [0002])) (hereinafter, referred to as Patent Document 1). In flattening processing, magnetic particles each of which has an approximately-spherical shape or a 3-dimensional shape similar thereto are flattened by causing the magnetic particles to collide with steel balls. However, because an increase in additive amount of Si increases the hardness as described above, there is a problem in that a time required for the flattening processing is elongated and the magnetic particles are broken to pieces during the flattening processing. The flattening processing is made additionally difficult when the magnetic particles become small.

Here, a rolling process is enabled by mixing a predetermined amount of P (phosphorous) to the sendust magnetic material (see, for example, Japanese Patent Application Laid-open No. Sho 55-65349 (page 11 of the specification)).

SUMMARY

However, in the technique of Patent Document 1, when an inappropriate amount of P is mixed into the Fe alloy magnetic material, a coercive force Hc increases, with the result that the magnetic material becomes difficult to be used at a communication frequency of 13.56 MHz generally used in current RFID systems.

In view of the above-mentioned circumstances, there is a need for a magnetic material that can readily be subjected to flattening processing and used at a communication frequency of 13.56 MHz, a magnetic sheet constituted of the magnetic material, and a portable electronic apparatus using the magnetic sheet.

According to an embodiment, there is provided a magnetic material used for an antenna module of an RFID (radio frequency identification) system that uses a communication frequency of 13.56 MHz, including an Fe alloy magnetic material containing Fe as a primary component, and Si and Al added thereto, and phosphorous of 0.2 to 0.5 wt % added to the Fe alloy magnetic material. Alternatively, the Fe alloy magnetic material may be a magnetic material containing Fe as a primary component and added with Si and Cr.

For example, when the magnetic material is processed into a magnetic sheet having a thickness of 0.25 mm, which is then used as a core of an antenna coil, in the RFID system using the magnetic material according to the embodiment of the present invention, a communication distance is expected to be at least 100 mm.

Here, the inventors of the present application have focused on a loss coefficient of the magnetic material and found that a compact-size antenna module with a large communication distance can be realized by structuring the magnetic material such that a product of an inverse number of the loss coefficient and a real part of complex magnetic permeability becomes a predetermined value or more. Specifically, when the inverse number of the loss coefficient ($\tan\delta=\mu''/\mu'$) represented by a real part $\mu'$ and an imaginary part $\mu''$ of complex magnetic permeability of the magnetic sheet having a thickness of 0.25 mm at a use frequency of 13.56 MHz is represented by Q, a performance index expressed by $\mu'*Q$ is desirably 600 or more. The magnetic sheet having a performance index ($\mu'*Q$) of 600 or more is capable of reducing a power loss of the antenna module due to an eddy current loss, and improving the communication distance without an increase in thickness of the magnetic sheet.

It has also been found from the relationship between the coercive force and the performance index ($\mu'*Q$) empirically obtained in advance that when the performance index ($\mu'*Q$) is 600 or more, the coercive force of the magnetic sheet becomes 300 AT/m or more. It has been empirically confirmed that, for the coercive force of the Fe alloy (which contains Fe as a primary component and to which Si, Al, Cr, and the like are added as described above) magnetic material to be maintained at 300 AT/m or more, an additive amount of phosphorous is preferably 0.2 wt % or more.

Meanwhile, because $\mu'$ at the use frequency of 13.56 MHz needs to be 25 or more, based on the relationship between the coercive force and $\mu'$, the coercive force is desirably 650 AT/m or less in this case. The relationship between the coercive force and $\mu'$ is obtained by a calculation or experiment based on the relationship between the coercive force and the performance index ($\mu'*Q$). It has been empirically confirmed that, for the coercive force to be maintained at 650 AT/m or less, the additive amount of phosphorous is preferably 0.5 wt % or less.

Thus, the additive amount of phosphorous can be obtained based on the communication distance, the performance index, and the like with a parameter, that is, the coercive force, as an axis. Specifically, by adding P to the Fe alloy magnetic material by 0.2 to 0.5 wt %, a predetermined communication distance can be secured, the magnetic sheet can be made thin, and the power loss due to the eddy current loss can be reduced, for example, while enabling the flattening processing. Moreover, according to an embodiment, a processing speed of the flattening processing can be increased.

According to another embodiment, there is provided a magnetic sheet used for an antenna module of an RFID (radio frequency identification) system that uses a communication frequency of 13.56 MHz, including an Fe alloy magnetic material containing Fe as a primary component, and Si and Al added thereto, and phosphorous of 0.2 to 0.5 wt % added to the Fe alloy magnetic material. Alternatively, the Fe alloy magnetic material may be a magnetic material containing Fe as a primary component and added with Si and Cr.

According to another embodiment, there is provided a portable electronic apparatus used in an RFID system (radio frequency identification) that uses a communication frequency of 13.56 MHz, including an antenna coil and a magnetic sheet. The magnetic sheet is disposed along the antenna coil and constituted of an Fe alloy magnetic material containing Fe as a primary component and added with Si, Al, and P of 0.2 to 0.5 wt %. Alternatively, the Fe alloy magnetic material may be a magnetic material containing Fe as a primary component and added with Si, Cr, and phosphorous of 0.2 to 0.5 wt %.

As described above, according to the embodiments, while the flattening processing can readily be performed, a predetermined communication distance can be secured, the magnetic sheet can be made thin, and the power loss due to the eddy current loss can be reduced, for example, while enabling the flattening processing.

Additional features and advantages are described herein, and will be apparent from the following Detailed Description and the figures.

DETAILED DESCRIPTION

Hereinafter, an embodiment of the present application will be described with reference to the drawings.

Figure 1:
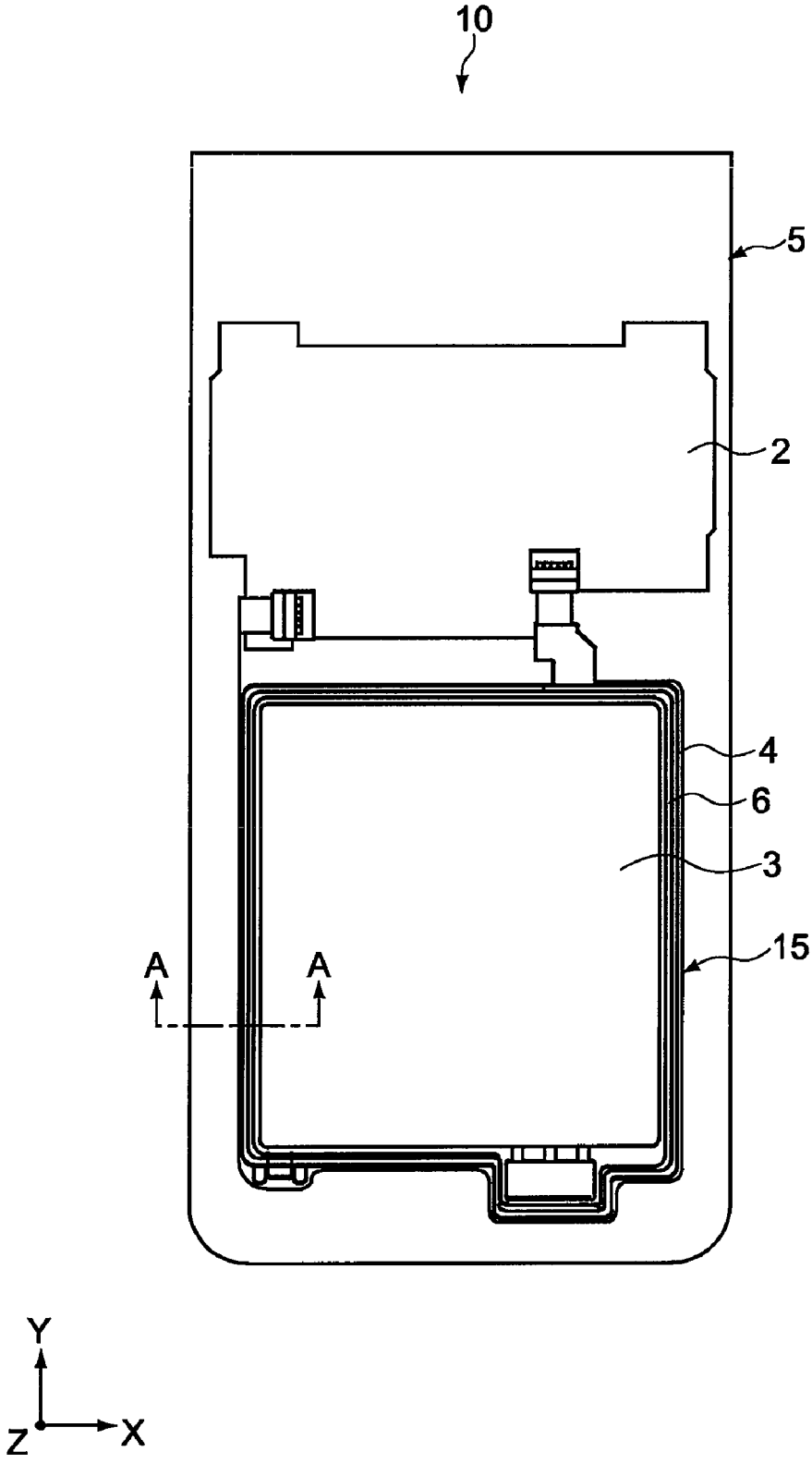
FIG. 1 is a schematic diagram showing a part of a cellular phone as a portable electronic apparatus according to an embodiment.

FIG. 1 is a schematic diagram showing a part of a cellular phone 10 as a portable electronic apparatus according to the embodiment of the present application.

The cellular phone 10 includes a main body 5 having a main circuit board 2 incorporated therein and a display unit (not shown). Typically, the main body 5 is provided with operation buttons (not shown) and the like. There are various types to the cellular phone 10, such as a foldaway type in which the main body 5 and the display unit can be folded together, a slide type in which the main body 5 and the display unit are slidable, and also a bar type in which the main body 5 and the display unit are formed integrally.

Although the cellular phone 10 is taken as an example, the portable electronic apparatus may instead be a PDA (personal digital assistant), a compact-size PC (personal computer), or other electronic apparatuses. Alternatively, the portable electronic apparatus may be a non-contact-type IC card dedicated to an RFID system.

The main body 5 includes a battery pack 3 electrically connected to the circuit board 2, and an antenna coil 4 and magnetic sheet 6 are disposed around the battery pack 3. The antenna coil 4 is electrically connected to an IC chip mounted to the circuit board 2. The antenna coil 4 and the magnetic sheet 6 are elements included in an antenna module 15 used in the RFID system.

Figure 2:
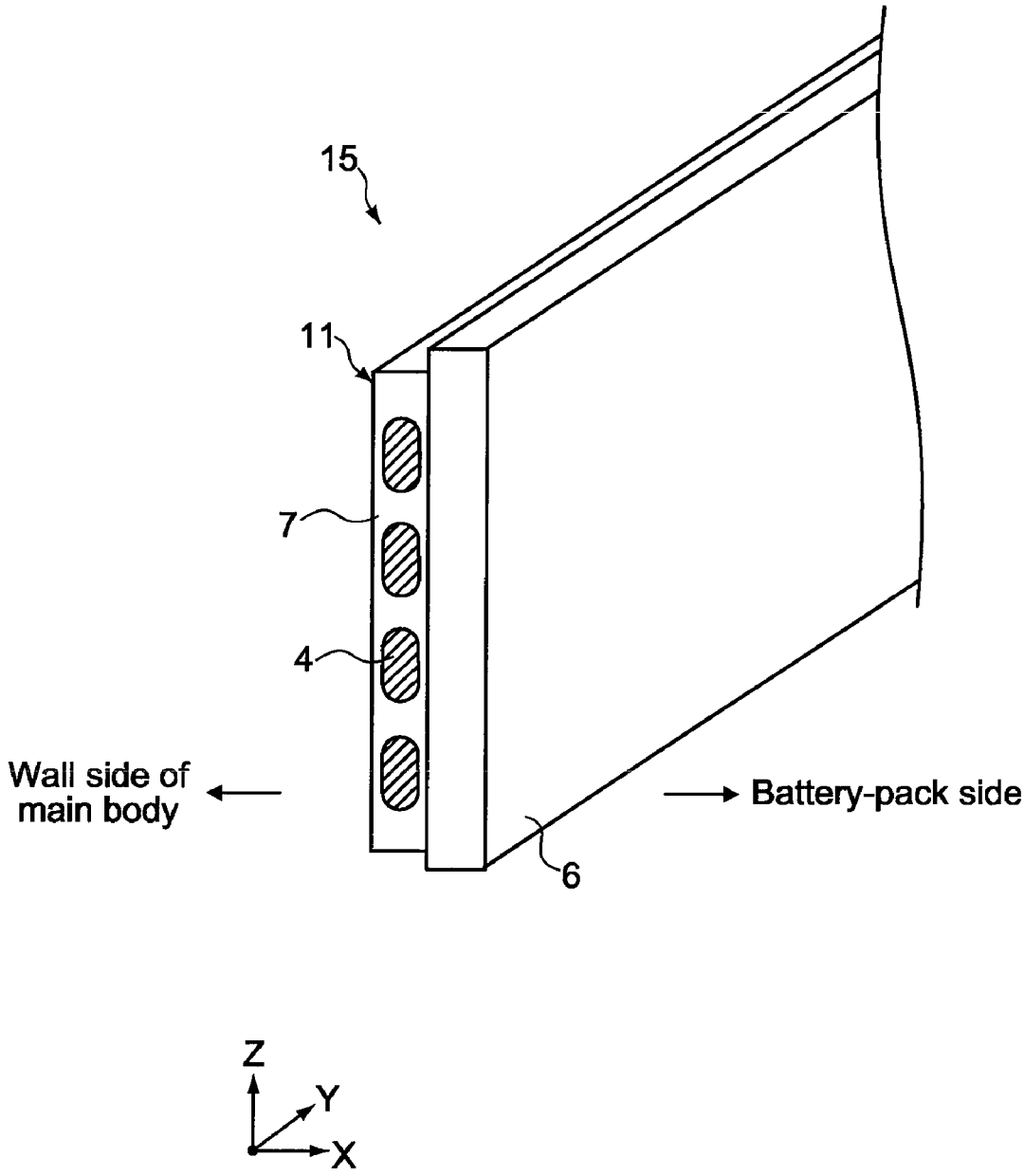
FIG. 2 is a cross-sectional diagram taken along the line A-A of FIG. 1, which shows a cross-section of an antenna coil and a magnetic sheet.

FIG. 2 is a cross-sectional diagram taken along the line A-A of FIG. 1, which shows a cross-section of the antenna coil 4 and the magnetic sheet 6.

The antenna coil 4 is wound a predetermined number of times with a thickness direction of the main body 5 of the cellular phone 10 (Z direction shown in FIGS. 1 and 2) as an axis. The antenna coil 4 is integrated with a flexible material 7 such as an FPC (flexible printed circuit) and an FFC (flexible flat cable). Hereinafter, a member obtained by integrating the flexible material 7 and the antenna coil 4 will be referred to as an antenna cable 11. The antenna coil 4 does not need to be wound as shown in FIG. 2, and may be a flat coil parallel to a principal surface (X-Y plane) of the main body 5.

The magnetic sheet 6 is disposed between the antenna cable 11 and the battery pack 3, and is bonded to the antenna cable 11 by an adhesive or other means. There are cases where a metal sheet (not shown) formed of a nonmagnetic material and provided for roughly adjusting a resonance frequency of the antenna coil 4 is disposed between the magnetic sheet 6 and the battery pack 3. When the metal sheet is disposed, the magnetic sheet 6 is also given a function of avoiding an electromagnetic interference between the antenna coil 4 and the metal sheet.

A shape, arrangement, and the like of the magnetic sheet 6 in the cellular phone 10 can suitably be changed depending on a shape, arrangement, and the like of the antenna coil 4, and the same holds true for other portable electronic apparatuses.

Next, descriptions will be given on a magnetic material as a raw material of the magnetic sheet 6.

The magnetic material according to the embodiment of the present invention is structured by adding P (phosphorous) to an Fe alloy (e.g., Fe—Si—Al and Fe—Si—Cr) magnetic material. A P additive amount is 0.2 to 0.5 wt %.

The following items (1) to (3) are examples of an Si—Al component ratio from among materials contained in the Fe—Si—Al—P magnetic material (unit of numbers is wt %).

(1) 10Si-4Al
(2) 10Si-5Al
(3) 9Si-6Al

The component ratios, however, are not limited to those above, and can suitably be changed. The Si—Cr component ratios of the Fe—Si—Cr magnetic material may be set similarly to the above items (1) to (3) (10Si-4Cr, 10Si-5Cr, and the like), but are not limited thereto.

Next, descriptions will be given on grounds for the numerical value range of 0.2 to 0.5 wt % that is set as the P additive amount.

Figure 3:
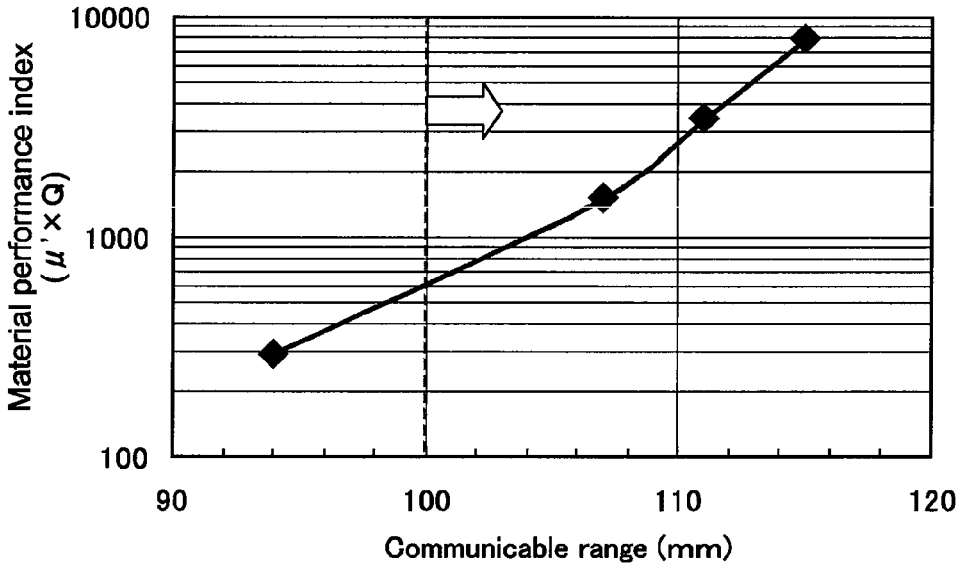
FIG. 3 is a graph showing a relationship between a communicable range (communication distance) of the antenna coil with the magnetic sheet having a thickness of 0.25 mm as a core and a performance index ($\mu'*Q$) of the magnetic sheet in an RFID system.

FIG. 3 is a graph showing a relationship between a communicable range (communication distance) of the antenna coil 4 with the magnetic sheet 6 having a thickness (X direction in FIGS. 1 and 2) of 0.25 mm as a core and a performance index ($\mu'*Q$) of the magnetic sheet 6 in the RFID system.

The inventors of the present application have focused on a loss coefficient of the magnetic material and found that a compact-size antenna module 15 with a large communication distance can be realized by structuring the magnetic material such that a product of an inverse number of the loss coefficient and a real part of complex magnetic permeability becomes a predetermined value or more. When the inverse number of the loss coefficient ($\tan \delta = \mu''/\mu'$) represented by a real part $\mu'$ and an imaginary part $\mu''$ of complex magnetic permeability of the magnetic sheet 6 at a use frequency is represented by Q, as long as the relationship between the performance index expressed by $\mu'*Q$ and the communication distance is obtained, a required performance index can be grasped from the required communication distance. The graph of FIG. 3 is obtained by an actual measurement and calculation. The performance index ($\mu'*Q$) with respect to the communication distance varies depending on the material.

In the RFID system, the communication distance that is actually required is at least 100 mm. In this case, it can be seen from the graph of FIG. 3 that the performance index ($\mu'*Q$) of the magnetic sheet 6 having a thickness of 0.25 mm is required to be 600 or more. The magnetic sheet 6 with a performance index ($\mu'*Q$) of 600 or more is capable of reducing a power loss of the antenna module 15 due to an eddy current loss, and improving the communication distance without an increase in thickness of the magnetic sheet 6.

It should be noted that in FIG. 3, $\mu'*Q$ is, for example, 1,500, 3,500, and 8,000 at the communication distances of 107 mm, 111 mm, and 115 mm, respectively.

Figure 4:
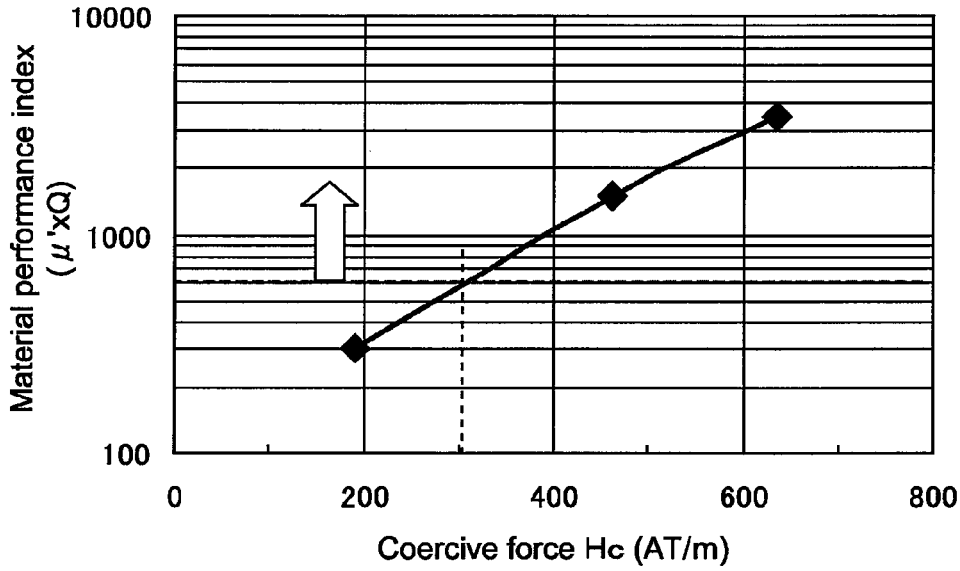
FIG. 4 is a graph showing a relationship between a coercive force and the performance index ($\mu'*Q$)
Figure 5:
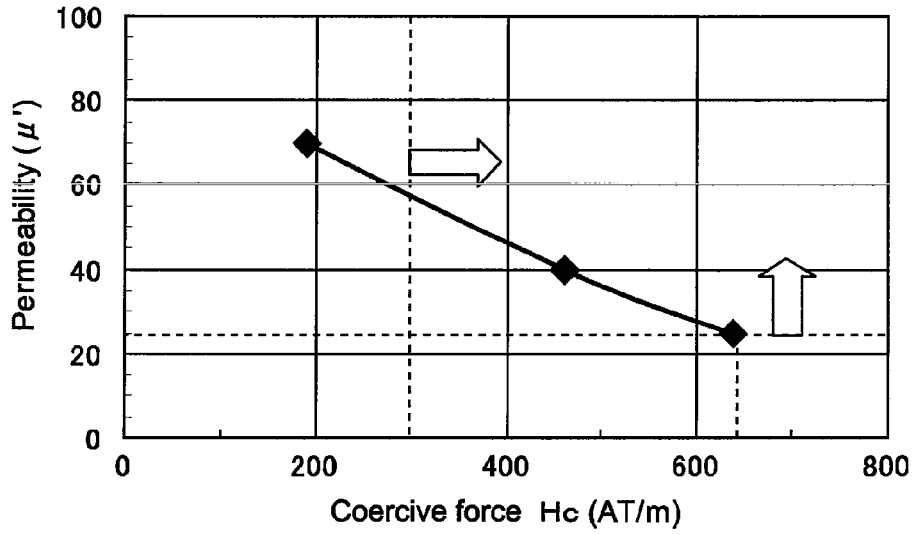
FIG. 5 is a graph showing a relationship between the coercive force and $\mu'$.

FIG. 4 is a graph showing a relationship between a coercive force Hc and the performance index ($\mu'*Q$) obtained by an actual measurement (confirmed data of magnetic sheet). It can be seen from the graph that when the performance index ($\mu'*Q$) is 600 or more, the coercive force of the magnetic sheet 6 is required to be 300 AT/m or more. On the other hand, FIG. 5 is a graph showing a relationship between the coercive force and $\mu'$. The relationship can be obtained by a calculation or actual measurement based on the relationship shown in FIG. 4 ($Q = \mu'/\mu''$).

Figure 6:
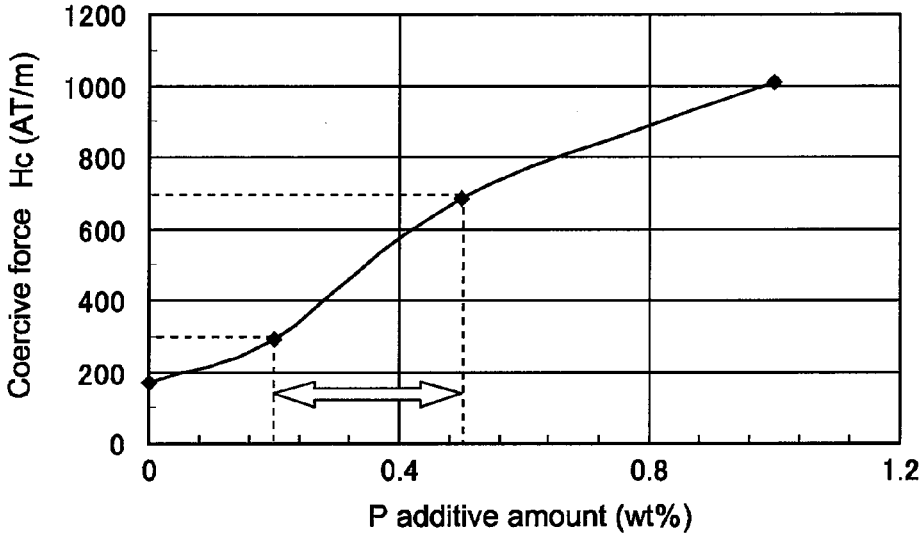
FIG. 6 is a graph showing a relationship between a P additive amount and the coercive force.

FIG. 6 is a graph showing a relationship between the P additive amount and the coercive force. The relationship can be obtained by an actual measurement (confirmed data of magnetic sheet). As described above, it is confirmed that the P additive amount is required to be 0.2 wt % or more in order to maintain the coercive force of the Fe alloy magnetic material constituting the magnetic sheet 6 at 300 AT/m or more.

On the other hand, because $\mu'$ at the use frequency of 13.56 MHz needs to be 25 or more, based on the graph of FIG. 5, the coercive force is desirably 650 AT/m or less in this case. It can be seen that the P additive amount is required to be 0.5 wt % or less in order to maintain the coercive force at 650 AT/m or less.

Thus, the P additive amount can be obtained based on the communication distance, the performance index ($\mu'*Q$), and the like with a parameter, that is, the coercive force, as an axis. Specifically, by adding P to the Fe alloy magnetic material by 0.2 to 0.5 wt %, a predetermined communication distance can be secured, the magnetic sheet 6 can be made thin, and the power loss due to the eddy current loss can be reduced, for example, while enabling the flattening processing. Moreover, according to the embodiment of the present invention, a processing speed of the flattening processing can be increased.

Figure 7:
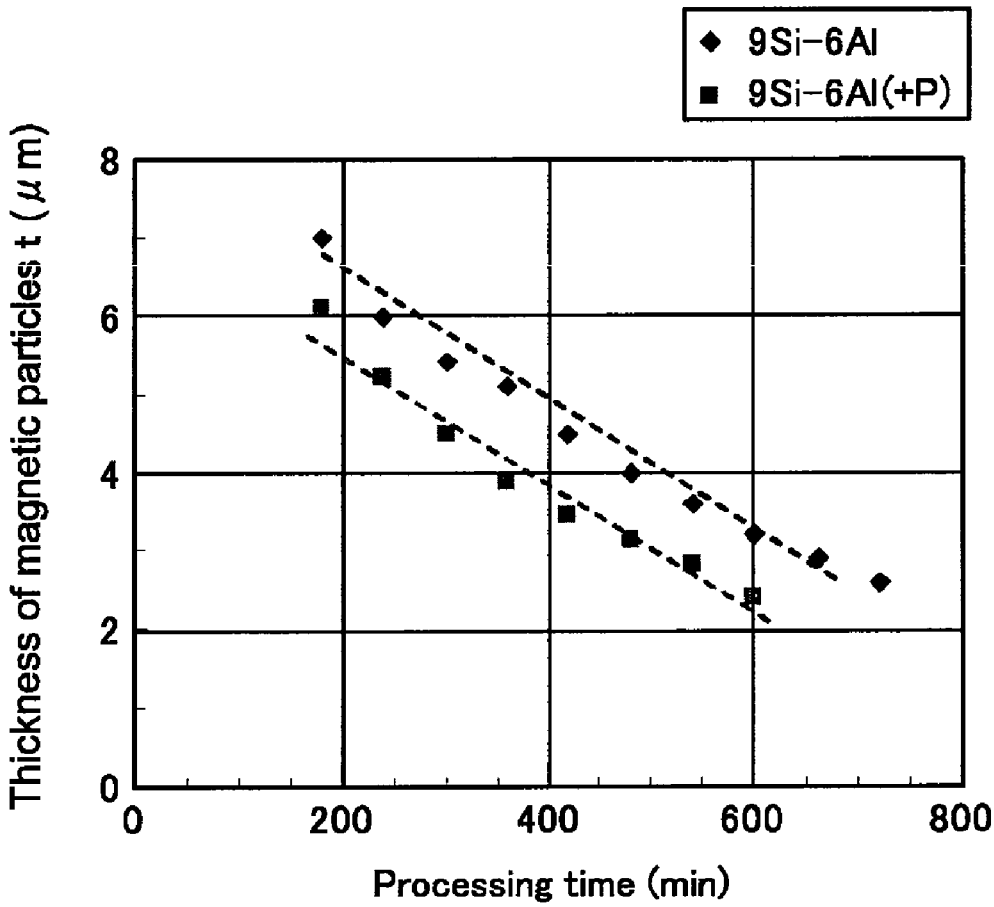
FIG. 7 is a graph showing a time (abscissa axis) required for magnetic particles to reach a predetermined thickness (ordinate axis) in flattening processing.

FIG. 7 is a graph showing results of an actual measurement of a time (abscissa axis) required for magnetic particles to reach a predetermined thickness (ordinate axis) in the flattening processing. A line on an upper side shows a result of 9Si-6Al and a line on a lower side shows a result of 9Si-6Al (+P) (magnetic material to which phosphorous has been added). The graph shows the time required for the magnetic particles to eventually reach a thickness of t=2.3 μm. It can be seen from the graph that the processing time is shortened by about 120 minutes.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A magnetic material consisting essentially of:
- an Fe alloy magnetic material containing Fe as a primary component, and Si and Al, added thereto; and
- phosphorous ranging from 0.2 to 0.5 wt % added to the Fe alloy magnetic material.

2. The magnetic material according to claim 1, wherein the Fe alloy magnetic material has a coercive force ranging from 300 to 650 AT/m.

3. A magnetic material consisting essentially of:
- an Fe alloy magnetic material containing Fe as a primary component, and Si and Cr added thereto; and
- phosphorous ranging from 0.2 to 0.5 wt % added to the Fe alloy magnetic material.

4. A magnetic sheet consisting essentially of:
- an Fe alloy magnetic material containing Fe as a primary component, and Si and Al added thereto; and
- phosphorous ranging from 0.2 to 0.5 wt % added to the Fe alloy magnetic material.

5. The magnetic sheet according to claim 4, wherein the magnetic sheet has a performance index ($\mu'*Q$) within a range of 600 or more to 8,000 or less when a communication distance of the antenna module that uses the magnetic sheet is ranging from 100 mm to 115 mm.

6. The magnetic sheet according to claim 4, wherein a thickness of the sheet is about 0.25 mm.

7. A magnetic sheet consisting essentially of:
- an Fe alloy magnetic material containing Fe as a primary component, and Si and Cr added thereto; and
- phosphorous ranging from 0.2 to 0.5 wt % added to the Fe alloy magnetic material.

8. The magnetic sheet according to claim 7, wherein a thickness of the sheet is about 0.25 mm.

9. A portable electronic apparatus used in a radio frequency identification system that uses a communication frequency of 13.56 MHz, comprising:
- an antenna coil; and
- a magnetic sheet disposed along the antenna coil and constituted of an Fe alloy magnetic material containing Fe as a primary component, and Si, Al, and P ranging from greater than 0.2 to 0.5 wt % added thereto.

10. The portable electronic apparatus according to claim 9, wherein a thickness of the sheet is about 0.25 mm.

11. A portable electronic apparatus used in a radio frequency identification system that uses a communication frequency of 13.56 MHz, comprising:
- an antenna coil; and
- a magnetic sheet disposed along the antenna coil and constituted of an Fe alloy magnetic material containing Fe as a primary component, and Si, Cr, and P ranging from greater than 0.2 to 0.5 wt % added thereto.

12. The portable electronic apparatus according to claim 11, wherein a thickness of the sheet is about 0.25 mm.

* * * * *